US010046841B2

(12) United States Patent
Schiller et al.

(10) Patent No.: US 10,046,841 B2
(45) **Date of Patent: *Aug. 14, 2018**

(54) WATER BIKE

(71) Applicant: SCHILLER SPORTS, INC., Mill Valley, CA (US)

(72) Inventors: Judah Schiller, Mill Valley, CA (US); Robert Frick, Mill Valley, CA (US); Martin Windmill, Mill Valley, CA (US)

(73) Assignee: Schiller Sports, Inc., Mill Valley, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/593,115

(22) Filed: May 11, 2017

(65) Prior Publication Data

US 2017/0247095 A1 Aug. 31, 2017

Related U.S. Application Data

(63) Continuation of application No. 14/757,841, filed on Dec. 23, 2015, now Pat. No. 9,650,109.

(Continued)

(51) Int. Cl.
*B63H 16/20* (2006.01)
*B63H 5/125* (2006.01)

(Continued)

(52) U.S. Cl.
CPC ..... *B63H 16/20* (2013.01); *B63B 1/121* (2013.01); *B63H 5/125* (2013.01); *B63H 25/02* (2013.01);

(Continued)

(58) Field of Classification Search
CPC .. B63B 1/12; B63B 1/121; B63B 1/14; B63B 35/73; B63B 35/74; B63H 5/125; B63H 16/20

(Continued)

(56) References Cited

U.S. PATENT DOCUMENTS 486,684 A 11/1892 Salisbury
1,761,884 A 6/1930 Gorski (Continued)

FOREIGN PATENT DOCUMENTS

BR 7501587-0 U 11/1997
BR 9704429-6 B1 9/2003

(Continued)

OTHER PUBLICATIONS

Korean Intellectual Property Office, International Search Report and Written Opinion for PCT/US2015/000472, 15 pgs, dated May 19, 2016.

(Continued)

*Primary Examiner* — Lars A Olson
(74) *Attorney, Agent, or Firm* — Perkins Coie LLP; Kenneth H. Ohriner

(57) ABSTRACT

A water bike has a frame supported on first and second spaced apart pontoons or similar floatation elements. Pedals are attached to cranks on a front sprocket rotatably supported on the frame. A chain or belt extends around the front sprocket and around a rear sprocket on a gearbox. An outdrive is supported on the gearbox and pivotal about a vertical axis relative to the gearbox. The combined outdrive and gearbox are pivotable about a horizontal axis relative to the frame. A propeller on the outdrive is mechanically linked to a first gear in the gearbox, with the first gear meshing with a second gear attached to the rear sprocket. A steering bar is pivotally attached to the frame. A steering linkage connects (Continued)

the steering bar to the outdrive, for pivoting the outdrive to steer the water bike.

20 Claims, 15 Drawing Sheets

Related U.S. Application Data

(60) Provisional application No. 62/096,205, filed on Dec. 23, 2014.

(51) Int. Cl.
*B63B 1/12* (2006.01)
*B63H 25/02* (2006.01)

(52) U.S. Cl.
CPC .. *B63H 2016/202* (2013.01); *B63H 2025/024* (2013.01)

(58) Field of Classification Search
USPC ..... 440/21, 27, 30
See application file for complete search history.

(56) References Cited

U.S. PATENT DOCUMENTS

| | | | | |
|---|---|---|---|---|
| 4,427,392 | A | 1/1984 | Schneider | |
| 5,374,206 | A | 12/1994 | Gregory | |
| 5,413,066 | A | 5/1995 | Spencer | |
| 5,718,611 | A | 2/1998 | Schlangen et al. | |
| 6,165,030 | A | 12/2000 | Lewis et al. | |
| 6,309,263 | B1 | 10/2001 | Mier-Maza | |
| 6,712,653 | B2 * | 3/2004 | Free | B63H 16/20 440/27 |
| 9,254,895 | B2 | 2/2016 | Choi | |
| 9,463,857 | B1 | 10/2016 | Schiller et al. | |
| 9,650,109 | B2 | 5/2017 | Schiller et al. | |

FOREIGN PATENT DOCUMENTS

| | | | |
|---|---|---|---|
| BR | 202012025412-9 | U2 | 10/2014 |
| CN | 201317234 | Y | 9/2009 |
| CN | 203601541 | U | 5/2014 |
| KR | 1020030090952 | A | 12/2003 |
| WO | 2009035252 | A2 | 3/2009 |
| WO | 20100091485 | A2 | 8/2010 |
| WO | 2014054866 | A1 | 4/2014 |

OTHER PUBLICATIONS

Patent Cooperation Treaty, Third Party Observation in PCT/US2015/000472 (Apr. 22, 2017).

Patent Cooperation Treaty, Third Party Observation in PCT/US2015/000472 (Apr. 24, 2017).

First Office Action for Chinese Application No. 201580076778.3; dated Jun. 27, 2018; 35 pages.

* cited by examiner

WATER BIKE

CROSS REFERENCE TO RELATED APPLICATIONS

This application is a Continuation of U.S. patent Ser. No. 14/757,841, filed Dec. 23, 2015, which claims the benefit of U.S. Provisional Patent Application No. 62/096,205, filed Dec. 23, 2014, both of which are incorporated herein by reference.

BACKGROUND OF THE INVENTION

The field of the invention is water bikes and related water craft powered via pedaling. Various water bikes have been proposed in the past. Generally, these types of water bikes have a bicycle style frame or a recumbent seat supported on pontoons. Pedals on the frame are linked to a propeller via a drive line. Although these designs have met with varying degrees of success, improved water bike designs are needed.

SUMMARY OF THE INVENTION

A water bike has a frame supported on one or more floatation elements, such as first and second spaced apart pontoons or similar floatation elements. Pedals are attached to cranks on a front sprocket rotatably supported on the frame. A chain or belt extends around the front sprocket and around a rear sprocket at a gearbox. An outdrive is supported on the gearbox and pivotable about a vertical axis relative to the gearbox for steering the water bike. A propeller on the outdrive is mechanically linked to a first gear in the gearbox, with the first gear meshing with a second gear attached to the rear sprocket. A steering bar is pivotally attached to the frame. A steering linkage connects the steering bar to the outdrive, for pivoting the outdrive to steer the water bike.

DETAILED DESCRIPTION

Figure 1:
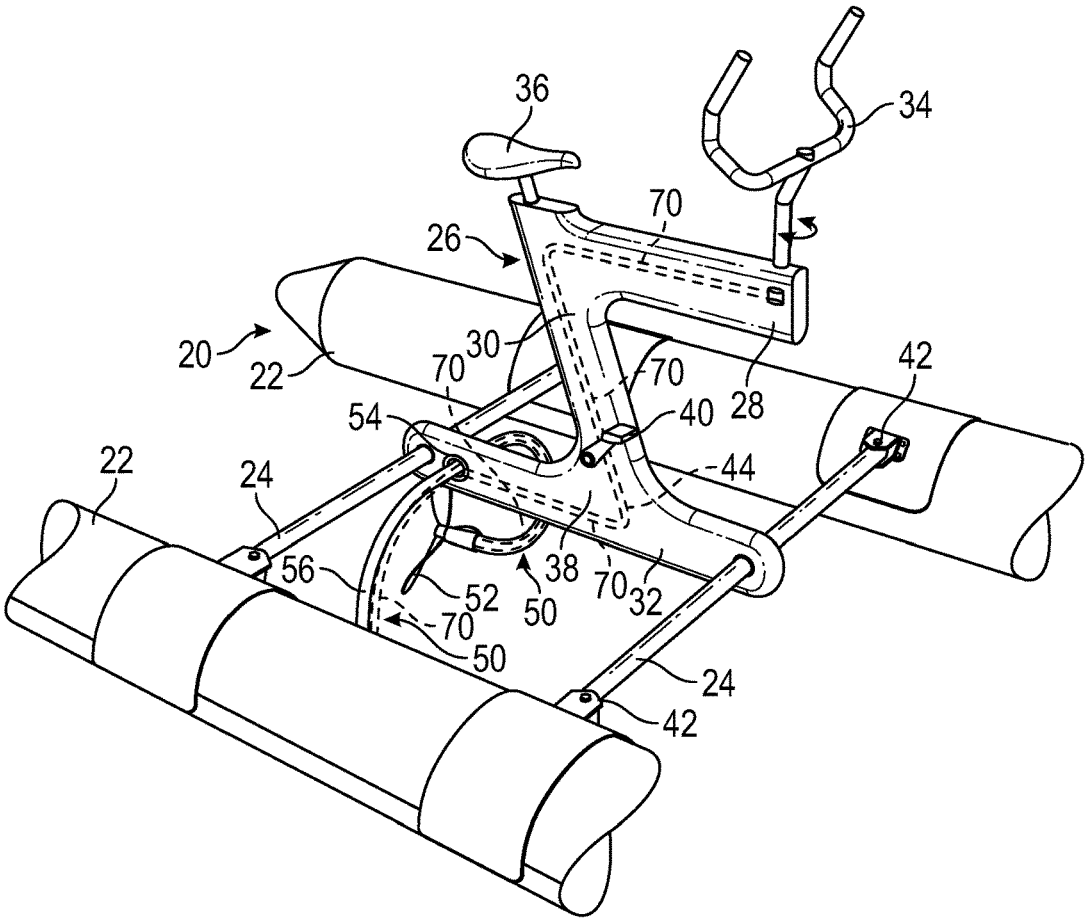
FIG. 1 is a front, top and right side perspective view of a water bike.
Figure 2:
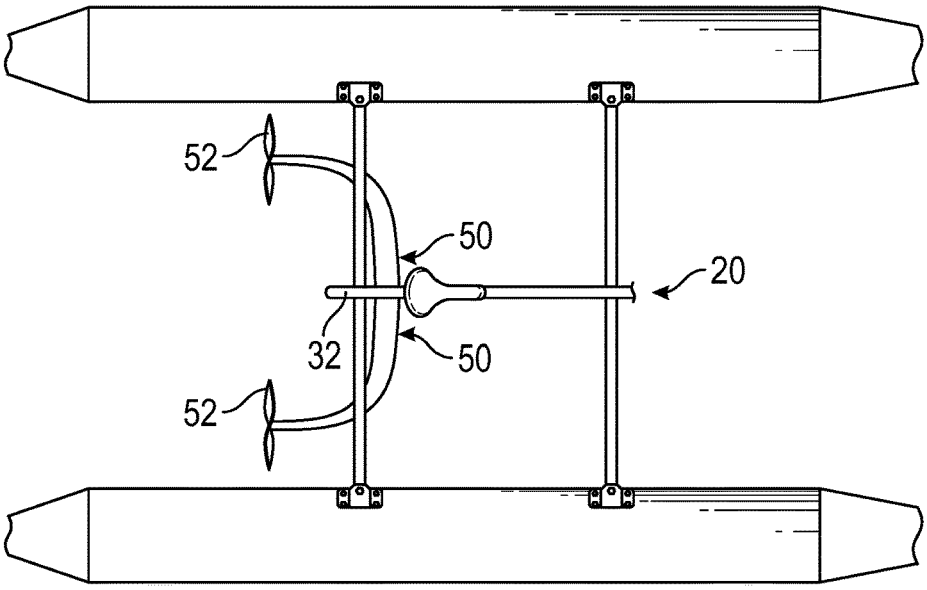
FIG. 2 is a plan view of the water bike of FIG. 1.
Figure 3:
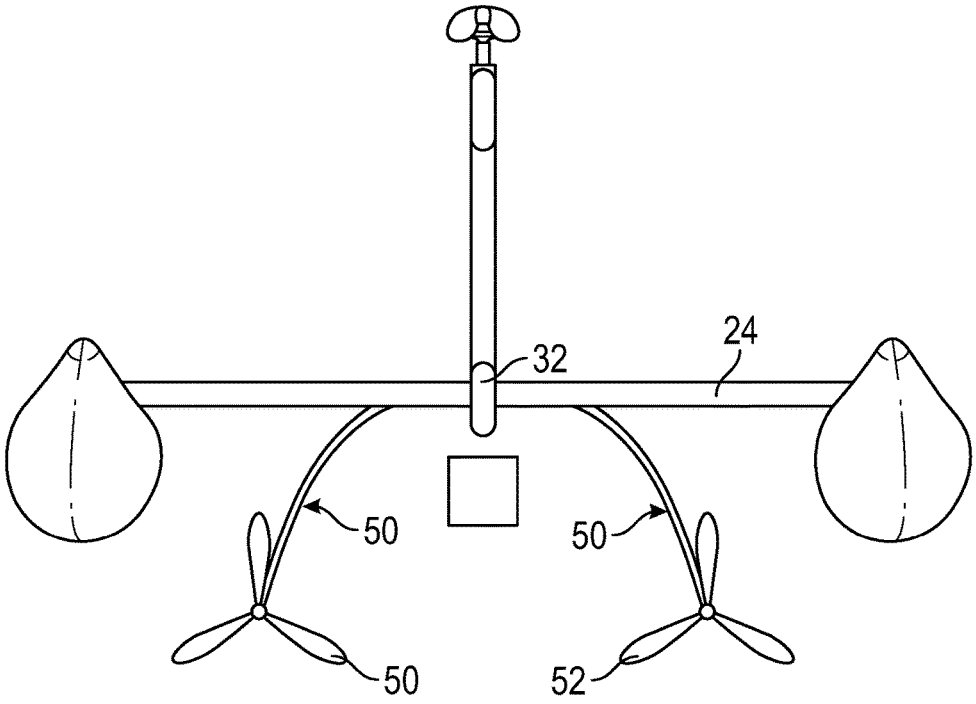
FIG. 3 is a front view.

FIGS. 1-11 show a first embodiment and FIGS. 12-24 show a second embodiment. As shown in FIGS. 1-4, a water bike 20 has one or more floatation elements such as a hull or pontoons. The example shown has two pontoons 22 connected via cross beams 24. The cross beams 24 may optionally be detached from the pontoons 22 via fittings 42, to facilitate transportation and storage of the water bike 20. A frame 26 is centrally supported between the pontoons 22 on the cross beams 24. The frame 26 may be described as having a top section 28, a riser 30 and a drive section 32. A seat 36 is attached to the frame, on the top section 28 or on the riser 30.

A handle bar 34 may be pivotally attached to a front end of the top section 28, to provide support for the rider, and a steering function as described below. Pedals 40 on cranks 38 on the frame 26 are mechanically linked to a drive line generally designated 44. The drive line 44 includes a drive multiplier which drives the propellers several times faster than the cranks 38. The drive multiplier may use gearing and/or belts and sprockets. The frame 26 may be dimensioned and the handle bar 34, the seat 36 and the pedals 40 positioned, to simulate a bicycle. The frame 26 may be a hollow weldment or molded structure.

Figure 4:
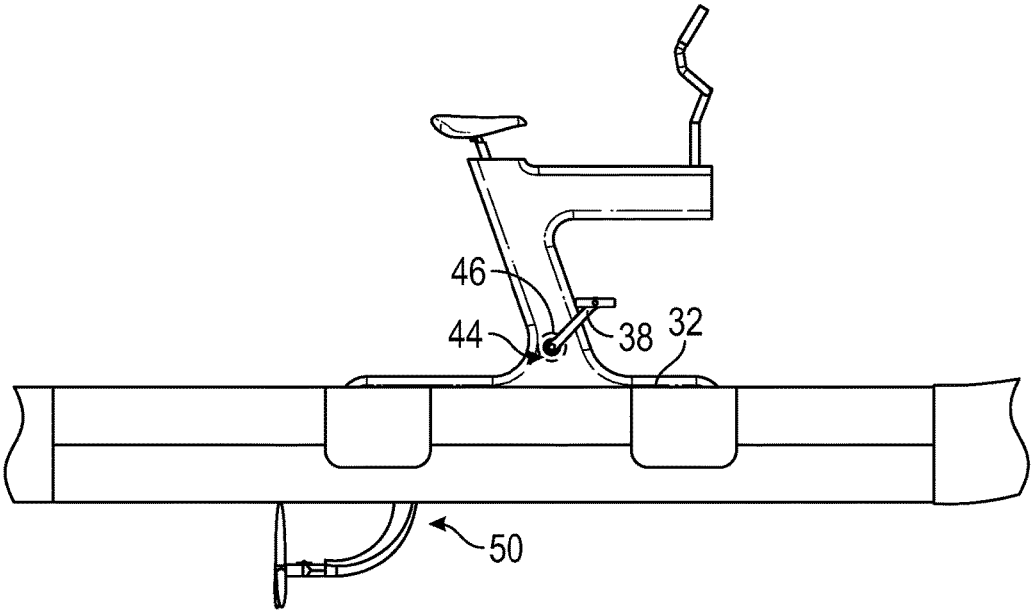
FIG. 4 is a side view.
Figure 5:
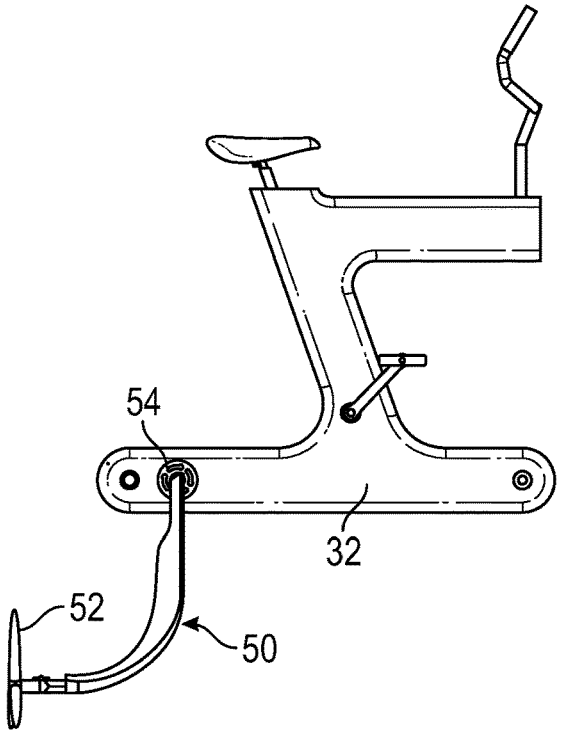
FIG. 5 is another side view shown with elements removed for purpose of illustration, and with the outdrive in a down position.
Figure 6:
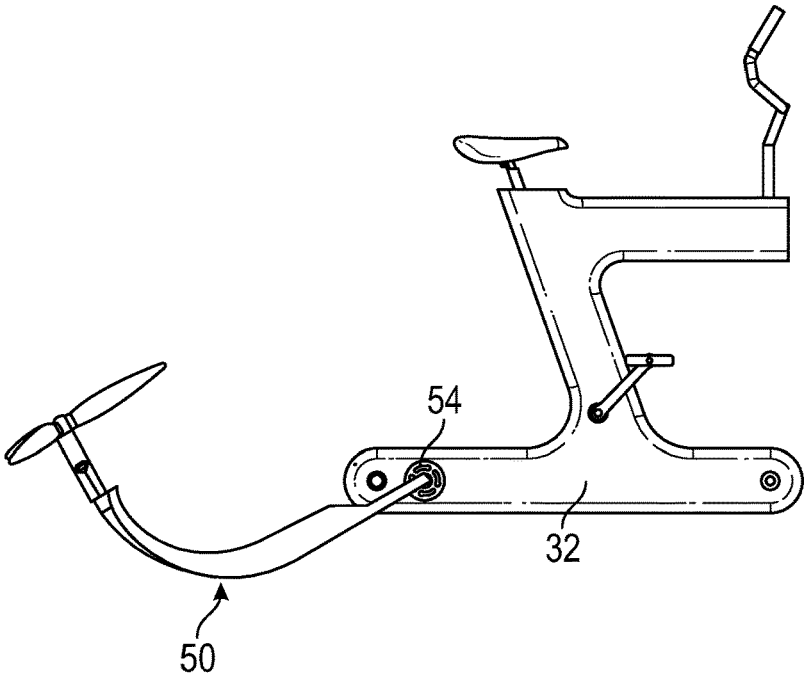
FIG. 6 is the same view as in FIG. 5 but with the outdrive in an up position.

Turning to FIGS. 4-6, left and right outdrives 50 are attached to left and right sides of the frame 26, optionally towards the back end of the drive section 32. Each outdrive is pivotable from a down position shown in FIG. 5, to an up position shown in FIG. 6. FIG. 5 shows the outdrive positions for the water bike 20 in use, while FIG. 6 shows the outdrive positions during dry transport or storage of the water bike 20, or as may be needed to clear underwater obstacles.

In use, thrust of the propellers holds the outdrives 50 in the down position. Consequently, the water bike 20 can operate without any latching or locking device to hold the outdrives 50 in the down position. However, a latching device may optionally be used for this purpose. In this case, a release line may run from the frame 26 or handle bar 34 to a latch release lever associated with the outdrive plate 54, to allow the user allow the outdrives 50 to move from the down to the up position.

Figure 7:
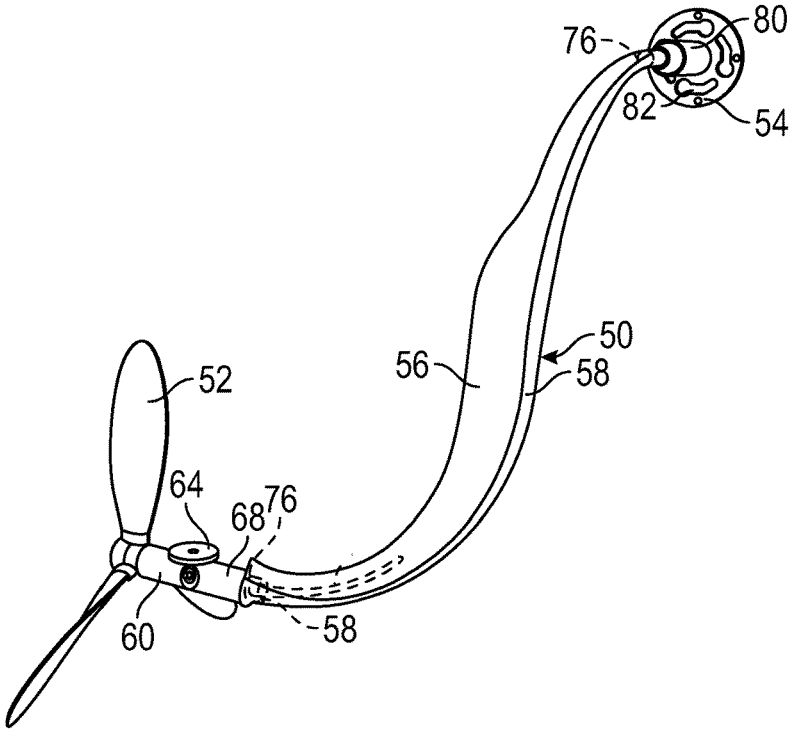
FIG. 7 is a side perspective view of the right outdrive shown in FIGS. 1-6, with the left outdrive a mirror image of the right outdrive.
Figure 8:
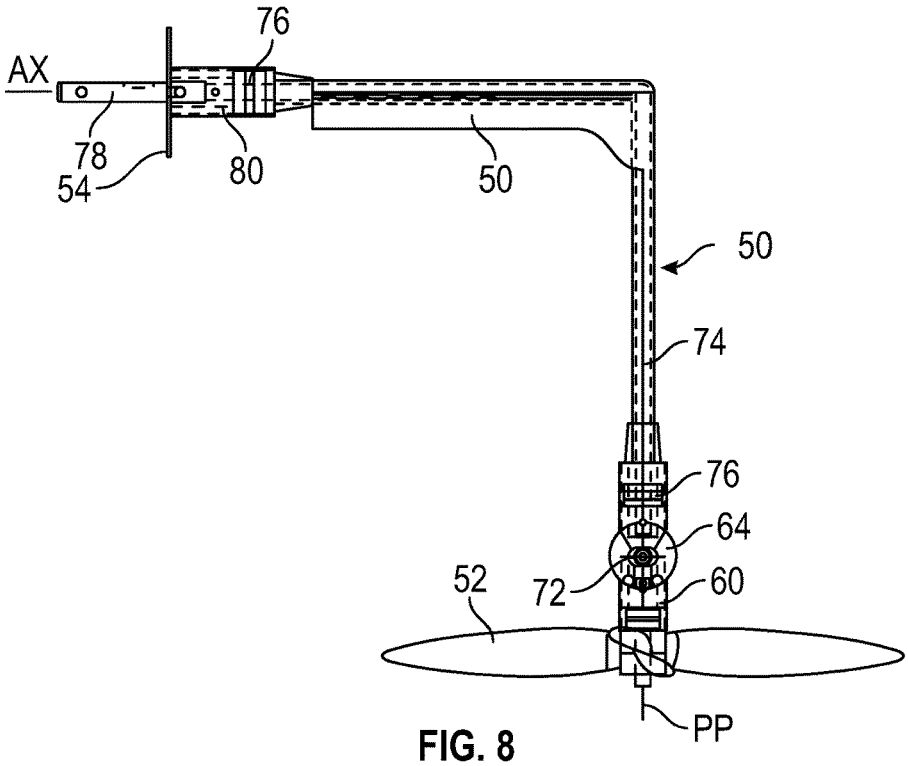
FIG. 8 is a top perspective view of the outdrive shown in FIG. 7.
Figure 9:
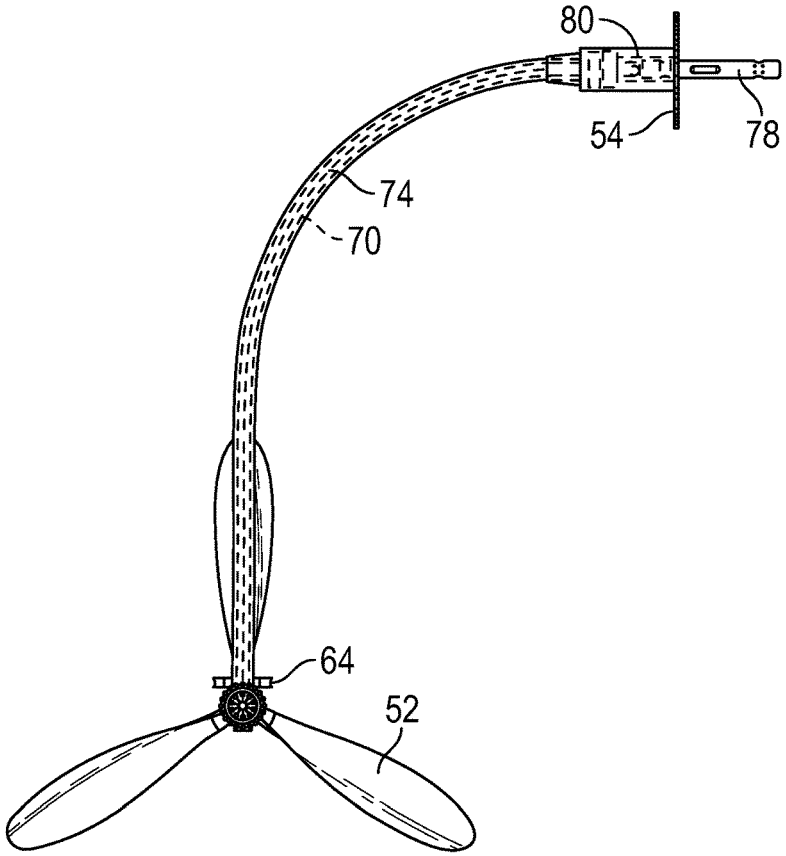
FIG. 9 is a rear phantom view of the outdrive of FIG. 7 showing internal components.
Figure 10:
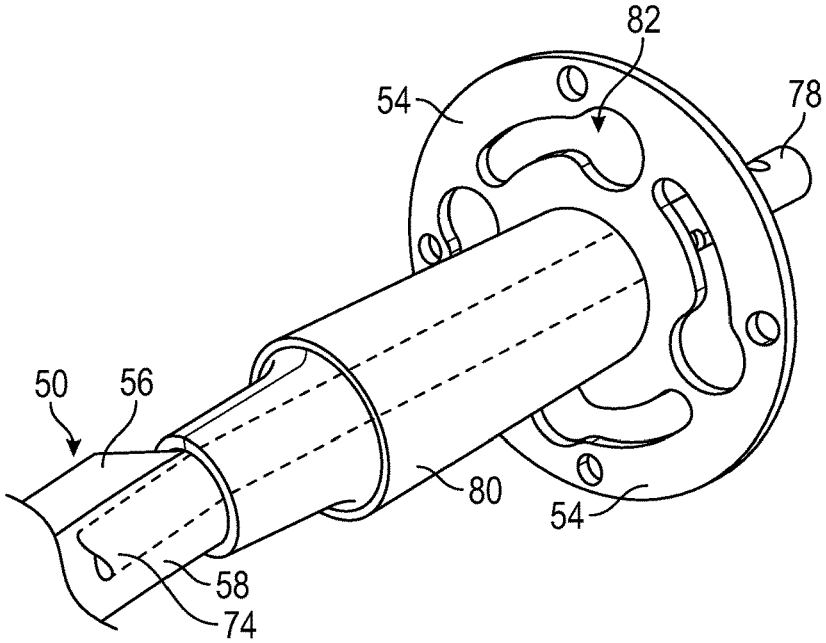
FIG. 10 is an enlarged front and top perspective view of the outdrive plate and axle hub shown in FIG. 7.

FIGS. 7 to 9 show the right outdrive 50. The left outdrive may be a mirror image of the right outdrive so that the description of the right outdrive below also describes the left outdrive. Consequently, references to outdrive refer to either the right outdrive, or the left outdrive, or both. The outdrive 50 may include a outdrive fin 56 attached to a outdrive tube 58. As shown in FIG. 10, an outdrive plate 54 may be attached to an axle hub 80 at the top or front end of the outdrive 50. The outdrive plate 54 is used to attach the outdrive 50 to the frame 26, and to allow the outdrive 50 to move into the up and down positions as shown in FIGS. 5 and 6. The outdrive plate 54 may have slotted holes 82 for this purpose, with bolts passing through the holes 82 threaded into the frame 26.

Figure 11:
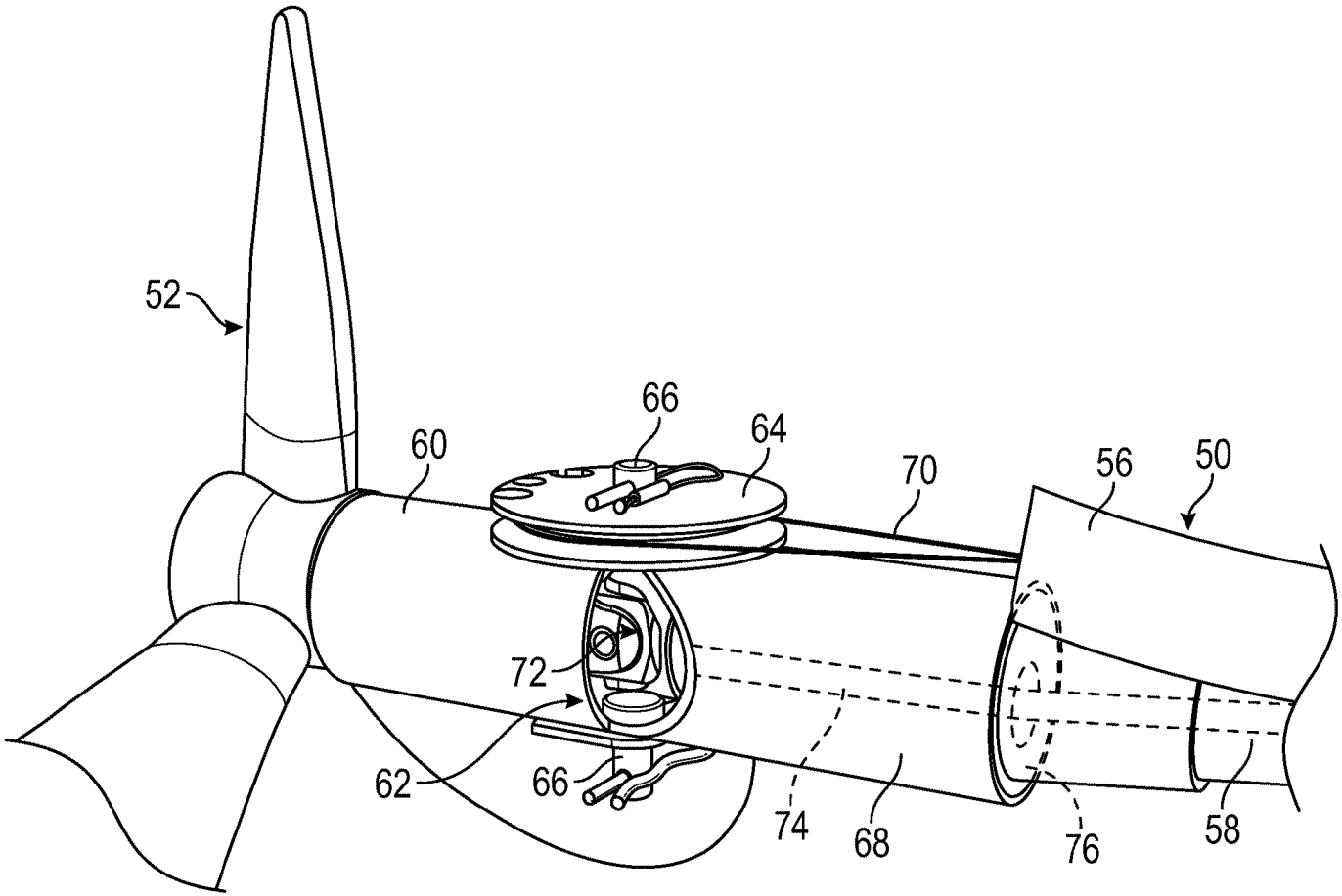
FIG. 11 is front, top and right side perspective view of the propeller end of the outdrive shown in FIG. 7.

As shown in FIG. 11 at the back or bottom end of the outdrive 50, a prop tube 60 is pivotally attached to an end of the outdrive tube 58, or an end stub 68 attached to the outdrive tube 58, via pivot pins 66. Consequently, the prop tube 60 can pivot left to right relative to the outdrive 50 to provide steering. A propeller 52 is rotatably attached onto the back end of the prop tube 60. A propeller shaft connects the propeller 52 to the back of a universal joint 72 within the prop tube 60. The front of the universal joint 72 is attached to a drive cable 74 extending out of the back end of the outdrive tube 58 and through the end stub 68.

The drive cable may typically be an 8-12 or 10-15 mm diameter wound wire cable. A recess 62 is provided in the side walls of the end stub 68 to provide side-to-side clearance for pivoting movement of the prop tube 60. A cable bearing 76 may be provided at the back end of the outdrive tube 58, or in the end stub 68 (if used) to align and support the drive cable 74, and optionally to seal water out of the outdrive tube 58. As shown in FIG. 7, a cable bearing 76 may also be provided in the axle hub 80. In this case, the ends of the drive cable 74 are centrally secured in place within the outdrive tube 58, while the central portion of the drive cable 74 may be free to move radially within the outdrive tube 58.

A pulley 64 may be attached to the top end of the upper pivot pin 66. A steering wire 72 on the pulley 64 runs through the fin 56 to the top end of the outdrive 50, and is connected directly or indirectly to the handle bar 34. Turning the handle bar 34 correspondingly turns the prop tube 60 to steer the water bike 20.

As shown in FIG. 8, an axle 78 is attached to the top or front end of the drive cable 74. The axle 78 is attached to a rear sprocket 48, with a chain or belt extending around the front and rear sprockets. The propeller axis PP is perpendicular to the axle axis AX. The drive cable 74 makes a smooth curving 90 degree transition without using gears, in this embodiment.

In use, a rider may sit on the seat 36 and pedal to actuate the drive line. Rotation of the cranks 38 turns a front gear or sprocket 46, which is multiplied via the drive line 44 to cause the drive cables 74 to rotate five to ten times faster than the front sprocket 46. Thus, for example, with the rider pedaling at a 60 rpm cadence, the drive cables 74 and propellers 52 are driven at 480 rpm. The propellers may be designed for human power, with an output of about 300 to 1500 watts, and with propulsion speeds of 1 to 3 meters per second. By positioning a universal joint at the output end of the shaft, on which a propeller can be coupled, a steering control system can be made integral to the assembly such that the steering control mechanism does not otherwise impede water flow.

In the embodiment of FIGS. 1-11, left and right outdrives are used. The design elements used in FIGS. 1-11 may also be used on a water bike having a single outdrive. Turning to FIGS. 12-21, a second embodiment having a single outdrive and other features is shown. Except as otherwise described below, the elements of the embodiment of FIGS. 1-11 described above may be used as well in the embodiment of FIGS. 12-21. The elements of the embodiment of FIGS. 12-21 may similarly be used in the embodiment of FIGS. 1-11.

Figure 12:
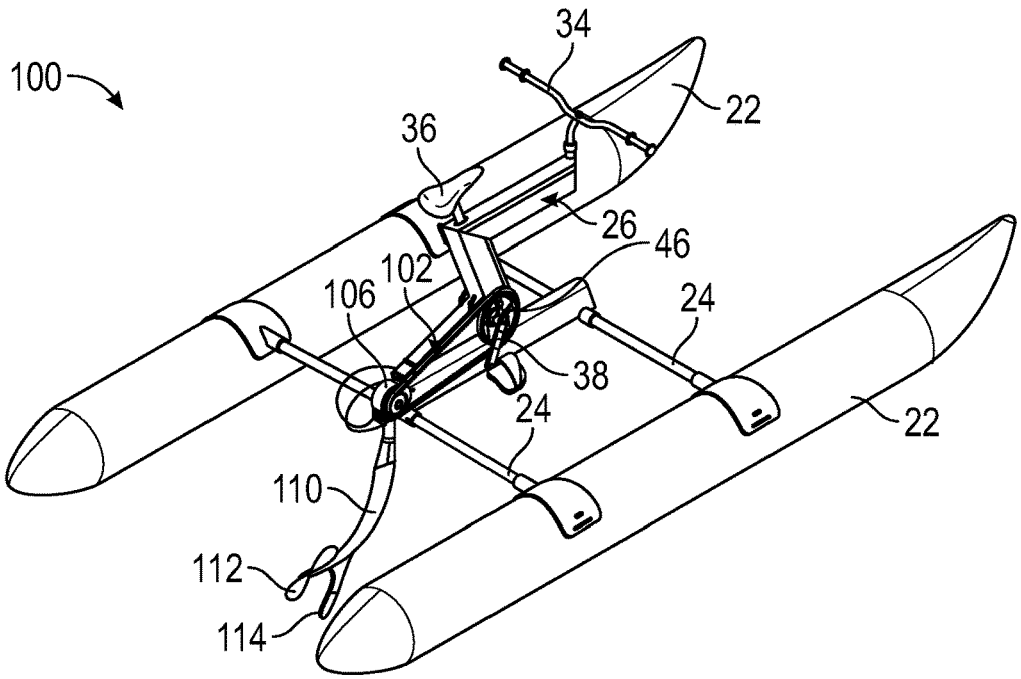
FIG. 12 is a perspective view of a second embodiment.
Figure 13:
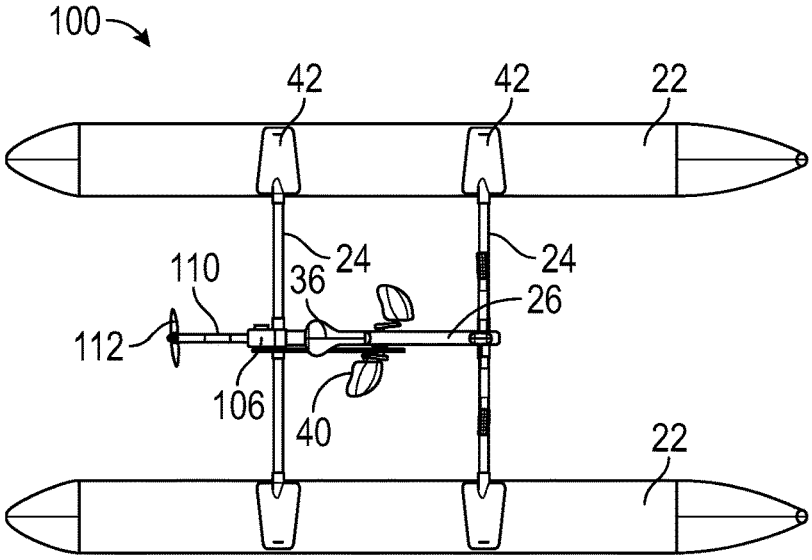
FIG. 13 is a top view of the water bike shown in FIG. 12.
Figure 14:
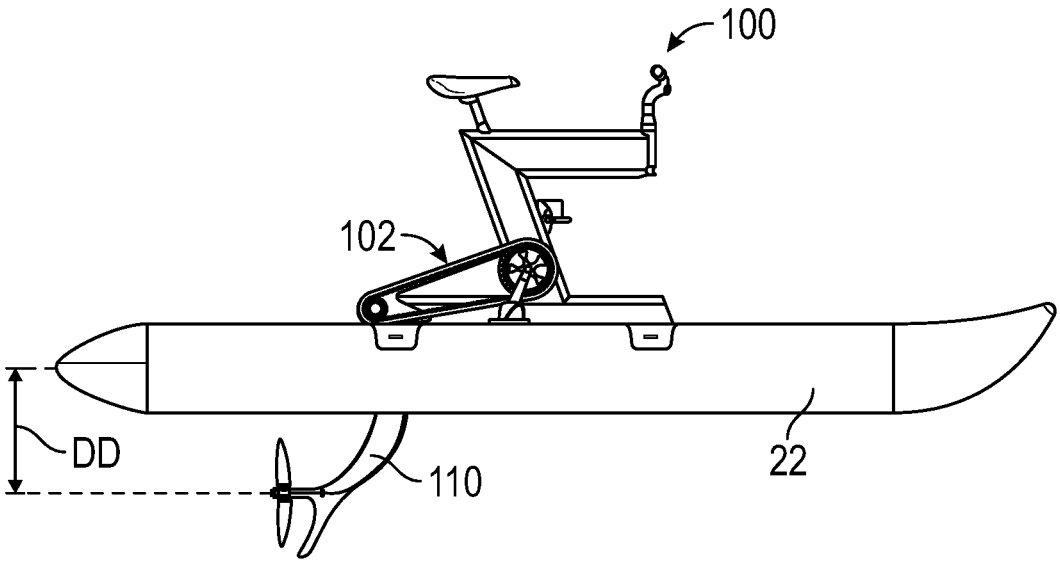
FIG. 14 is a side view of the water bike shown in FIG. 12 with the outdrive in a full down position.
Figure 15:
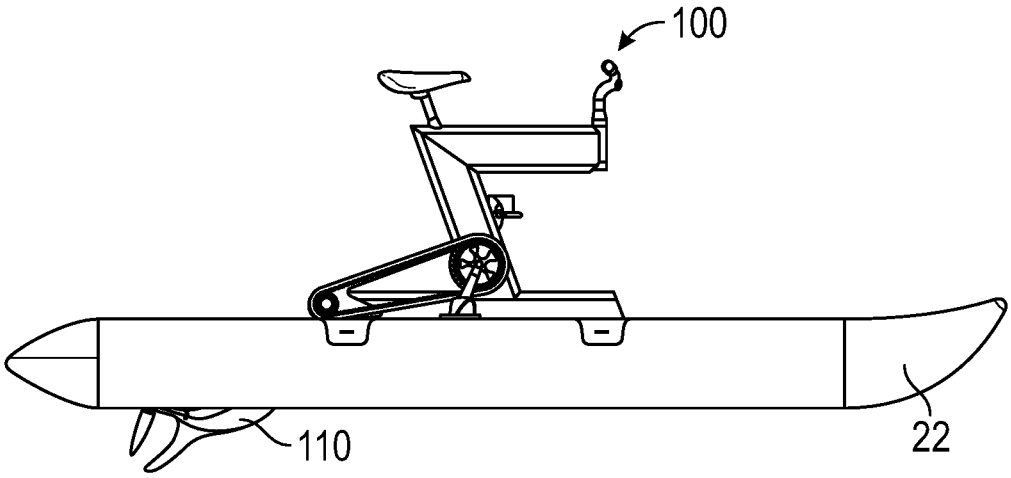
FIG. 15 is a side view of the water bike shown in FIG. 12 with the outdrive in a partial up or shallow water position.
Figure 16:
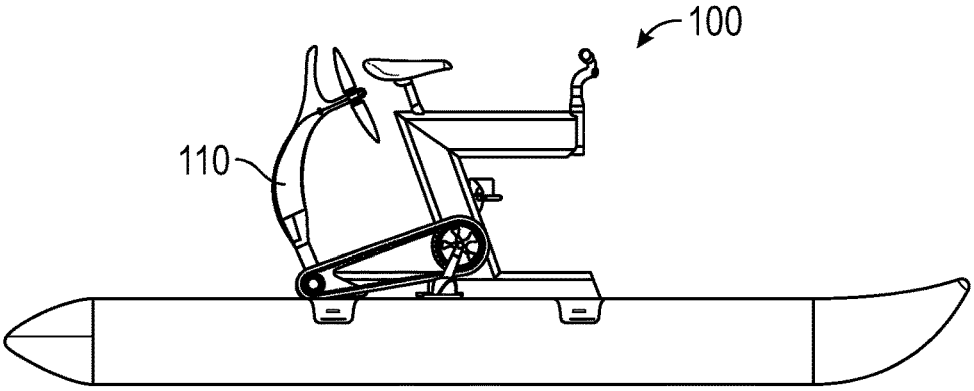
FIG. 16 is a side view of the water bike shown in FIG. 12 with the outdrive in a full up position for storage or transport.

As shown in FIGS. 12-14, a second embodiment of a water bike 100 has a drive line generally designated by 102. The drive line 102 includes pedals 40 on cranks 38 attached to a front sprocket 46. A chain or belt 70 extends around the front sprocket 46 and around a rear sprocket 48 alongside of a gear box 106. A single outdrive 110 is supported on the gear box 106. FIGS. 12-14 shown the outdrive 110 in a full down position, for ordinary use. In this position the axis of the propeller 112 is below the centerline of the pontoons 22 by dimension DD, typically about 50 to 75 cm. FIG. 15 shows the outdrive 110 partially raised, for use in shallow water. FIG. 16 shows the outdrive 110 in a full up position for storage or transport position.

Figure 17:
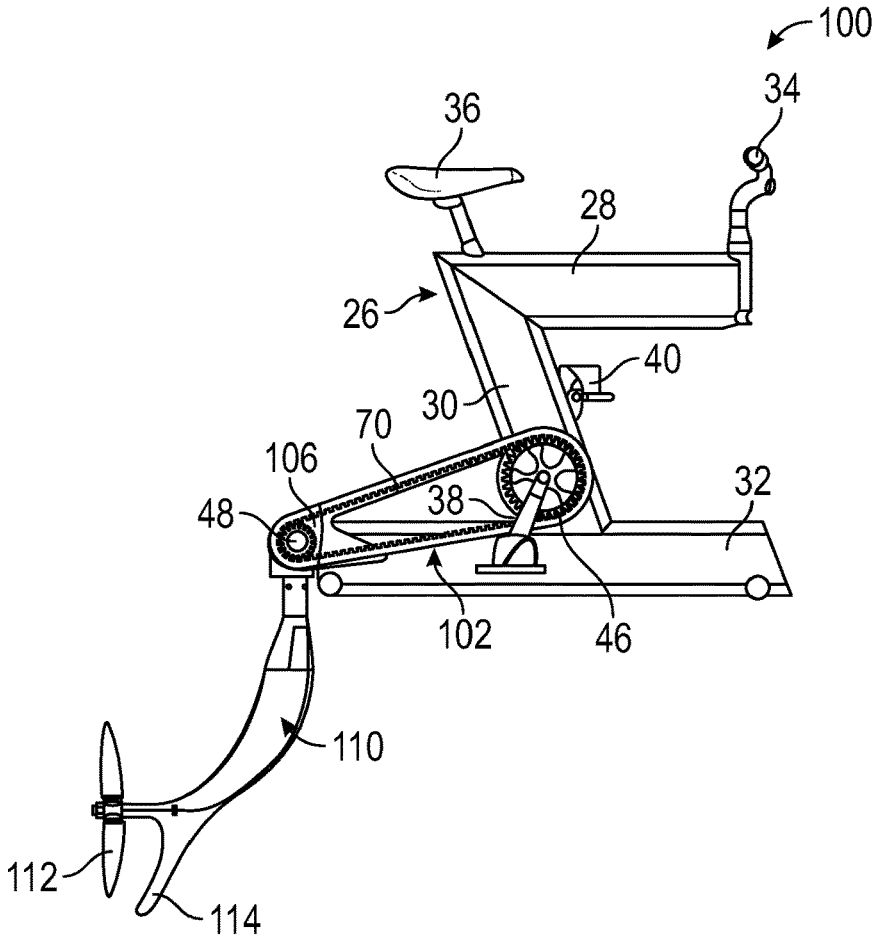
FIG. 17 is a side view of the drive line of the water bike shown in FIG. 12.
Figure 18:
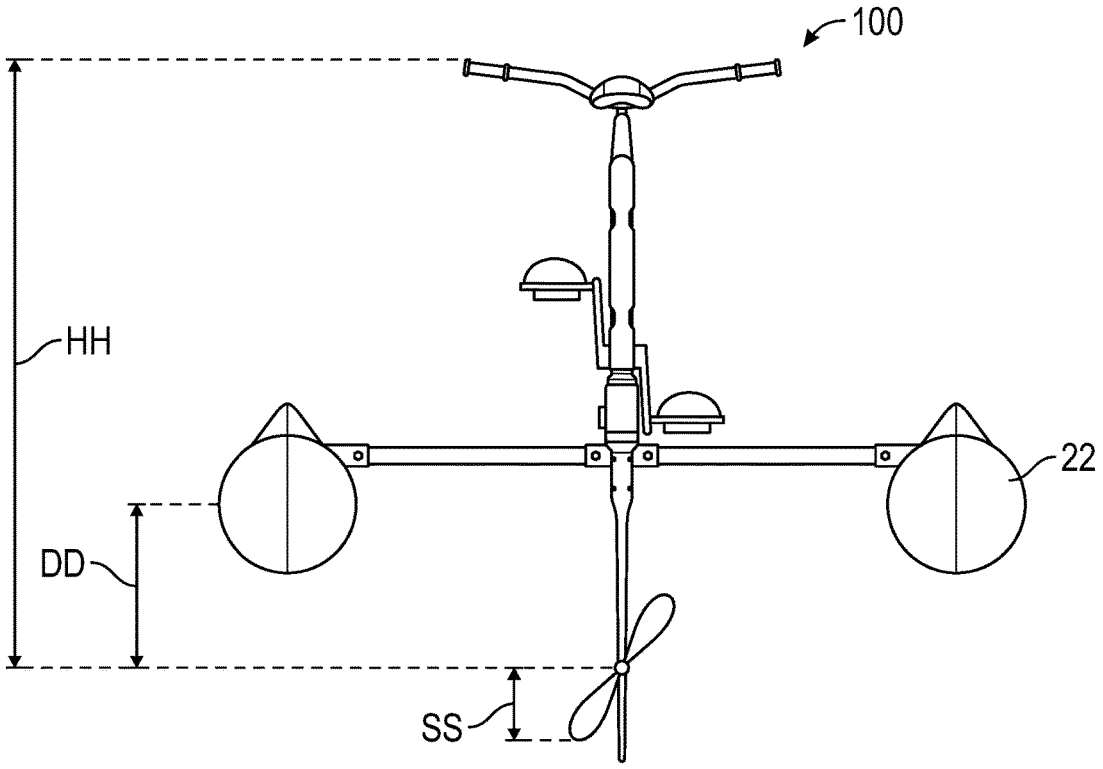
FIG. 18 is a rear view of the water bike as shown in FIG. 14.

FIG. 17 shows the frame 26 of the water bike 100 separated from the pontoons 22. The fin 114 at the bottom of the outdrive 110 extends slightly below the propeller 112 and protects the propeller from impact damage. FIG. 18 shown relative dimensions of the water bike 100 with dimension HH from the propeller axis to the handle bar typically about 150 to 215 cm, and the effective skeg length SS of about 10 to 20 cm.

Figure 20:
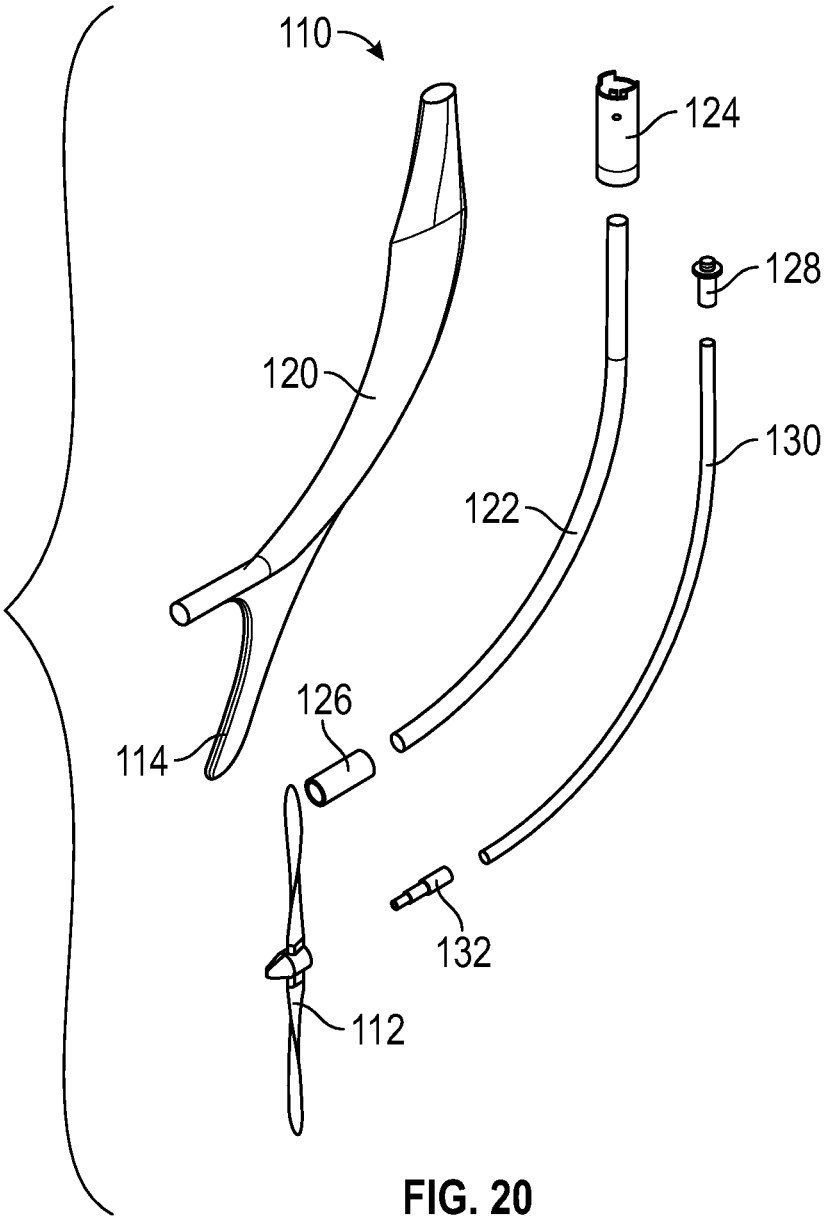
FIG. 20 is an exploded perspective view of the outdrive shown in FIG. 12.

As shown in FIG. 20, the outdrive 110 includes a cable housing 122 within a outdrive housing 120. The cable housing 122 may be a rigid curved tube, with the upper end of the cable housing 122 attached to a steering collar 124, and the lower end of the cable housing 122 attached to a centering tube 126, to hold the cable housing 122 in place within the outdrive housing 120. The propeller 112 is attached to a propeller collar 132 at the lower end of a propeller cable 130 extending through the cable housing 122. A gear collar 128 is attached to the upper end of the propeller cable 130.

The outdrive 110 may be manufactured as a molded composite fin structure around a bent tube. The outdrive housing 120 has a width generally of 25 to 50 mm so that drag is reduced. The narrow width of the outdrive housing 120, together with the propeller 112 having two blades, also allows the outdrive 110 to be separately shipped and stored in a compact space.

Figure 21:
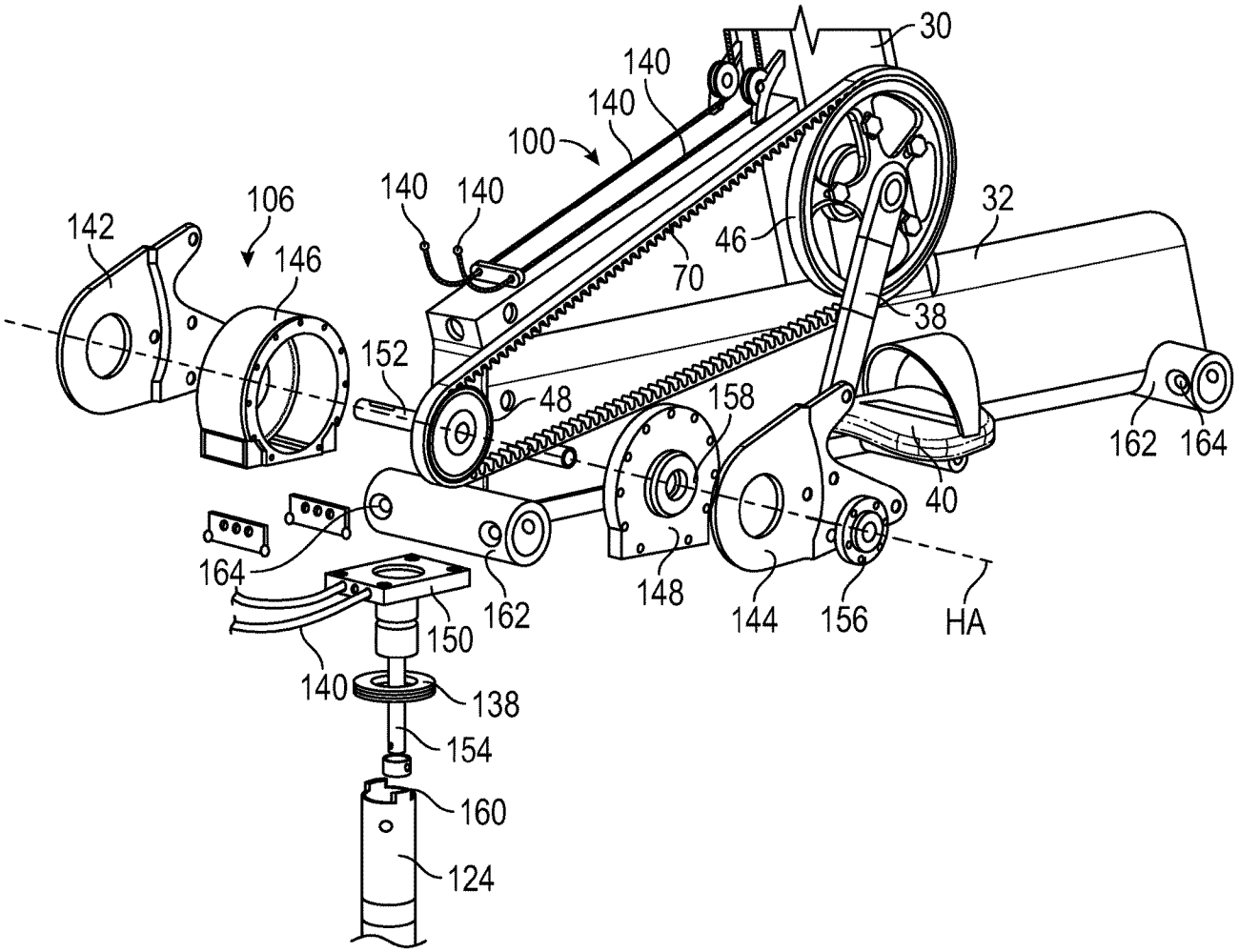
FIG. 21 is an exploded perspective view of the gearbox shown in FIG. 12.
Figure 22:
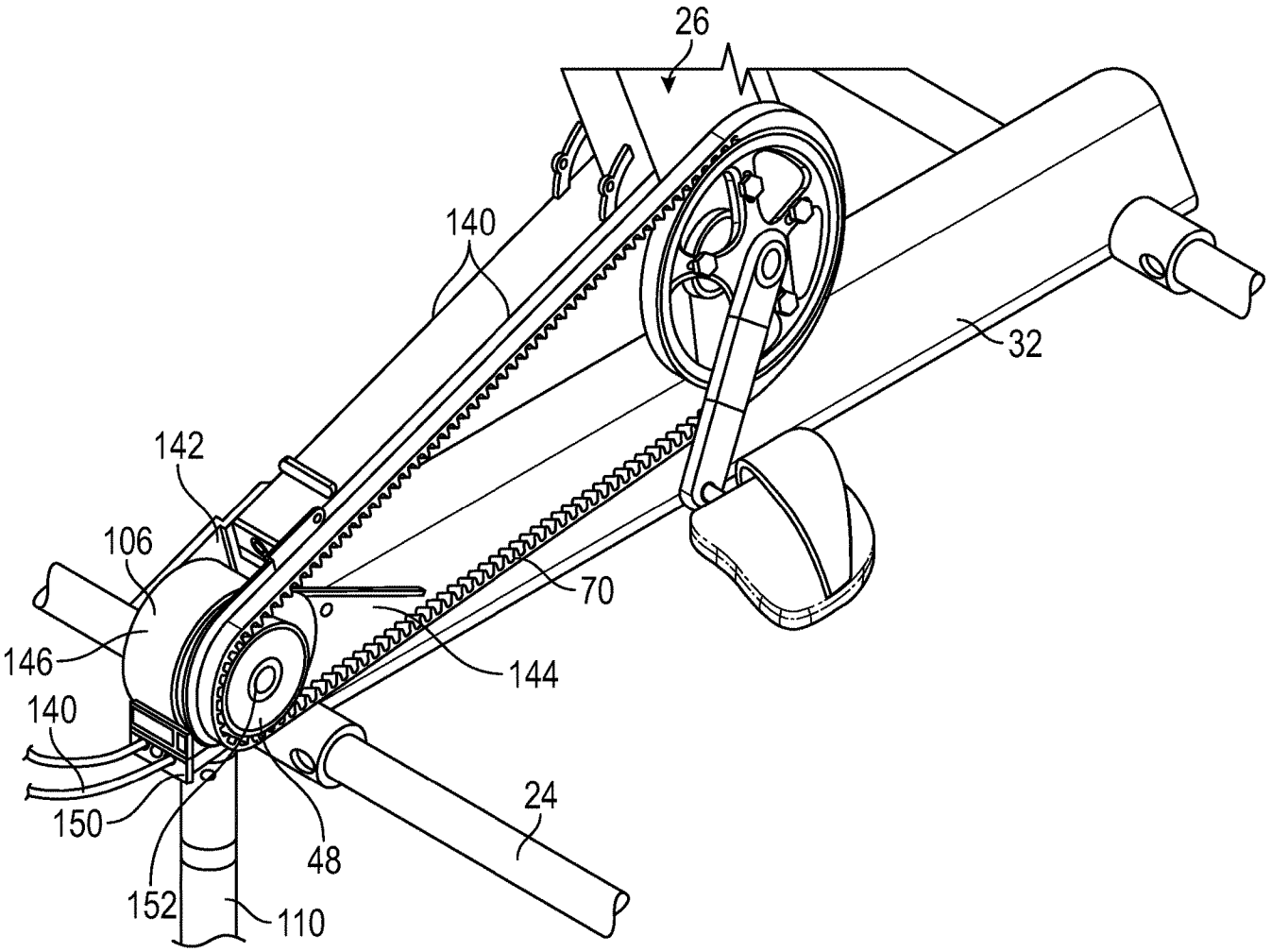
FIG. 22 is an enlarged view of the gearbox as shown in FIG. 12.
Figure 23:
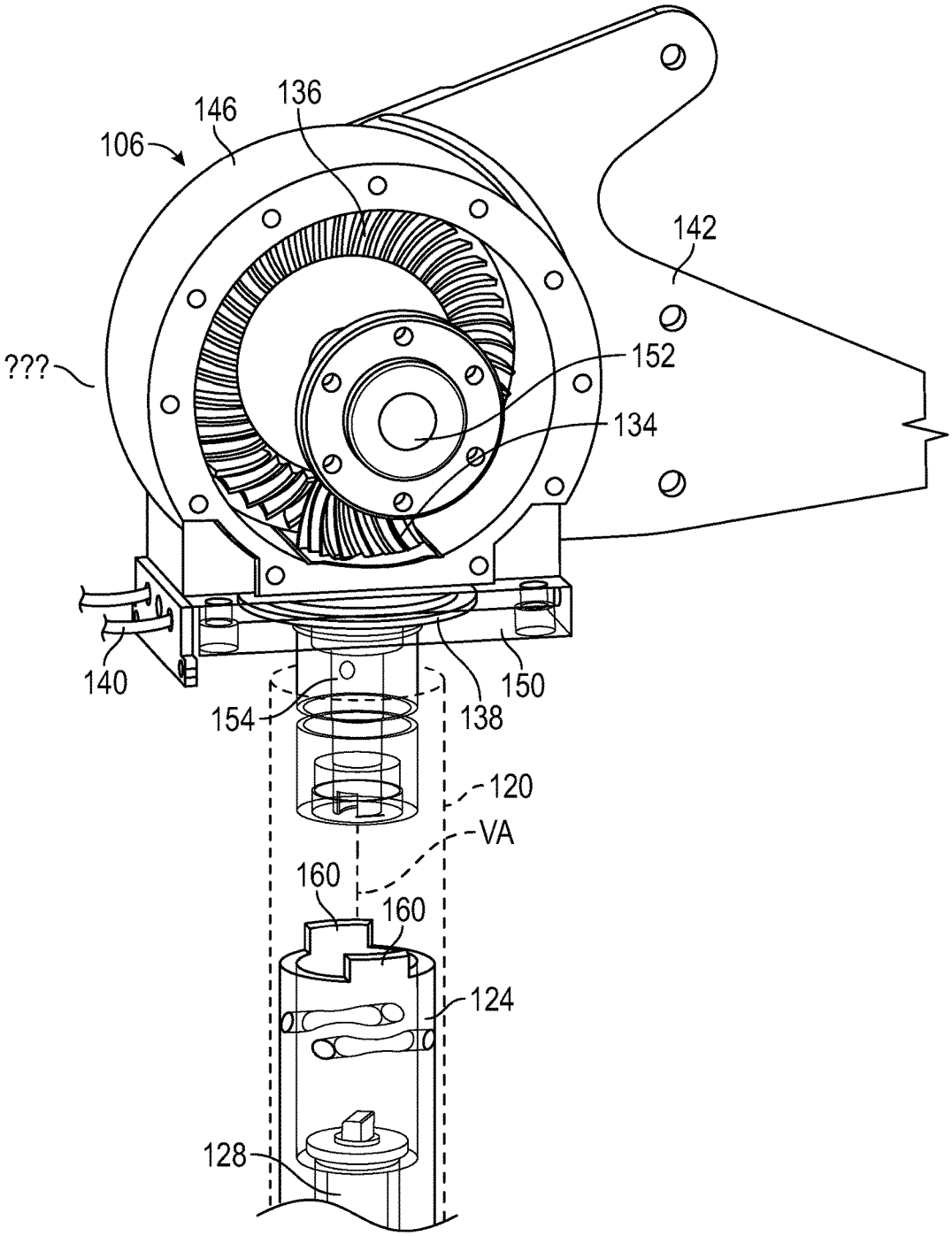
FIG. 23 is a perspective view of the gearbox shown in FIG. 22 with components removed for purpose of illustration.

Referring to FIG. 21, the gearbox 106, in the example shown, has a bearing plate 148 and a pinion housing 150 bolted onto a main housing 146. The gearbox 106 is pivotally supported on and between a left mounting plate 142 and a right mounting plate 144, with the left and right mounting plates rigidly attached to the frame 26. As shown in FIG. 23, a spiral sprocket gear 136 inside the main housing 146 is rigidly attached to an axle 152 which extends through a bearing 156 and the bearing plate 148, and out of the gearbox 106, and through the right mounting plate 144. Referring also now to FIG. 22, the rear sprocket 48 is rigidly attached to the axle 152, outside of the gearbox 106.

A clutch plate 158 may be provided between the bearing plate and the right mounting plate 144, to select a desired amount of friction between them, which determine the amount of force needed to pivot the outdrive 110 from the down position shown in FIG. 17, to the up position shown in FIG. 16, or to otherwise pivot the outdrive up upon impact with a floating or submerged object. The clutch plate 158, if used, may be adjustable. The gearbox 106 may be sealed and permanently lubricated.

As shown in FIGS. 21 and 23, the steering collar 124 at the upper end of the outdrive housing 120 is attached to, or engages, a steering pulley 138, optionally via collar tabs 160 inserted into slots in the steering pulley 138. The steering pulley 138 is pivotally attached onto the pinion housing 150 shown on the bottom of the gear box 106.

Steering cables 140 are attached to the steering pulley 138 and extend up via guides and idler rollers on the frame to a post supporting the handle bar 34. Rotating the handle bar 34 to the left or right correspondingly rotates the steering pulley 138, and the outdrive 110 to effect steering of the water bike 20 or 100, by rotating the entire outdrive 110 about the vertical axis VA, shown in FIG. 23. The steering collar 124 may also optionally be attached to a support collar rotatably supported on the pinion housing 150 (for example via a quick release pin), so that the weight and other forces acting on the outdrive are carried by the pinion housing 150 and largely not by the steering pulley 138. In this design the steering pulley 138 acts only to apply torque to rotate the outdrive 110 for steering, without the need for also structurally supporting the outdrive 110.

The outdrive 110 along with the gearbox 106 is pivotable about the horizontal axis HA shown in FIG. 21 from the down position shown in FIG. 12 to the up position shown in FIG. 16, as well as into any intermediate positions, such as the shallow water position shown in FIG. 15. The back ends of the steering cables 140 may be formed into loops, as shown in FIG. 12, to avoid interfering with this pivoting movement of the gearbox 106. The steering cables 140 may optionally be replaced by hydraulic lines.

As shown in FIG. 23, the gear collar 128 is attached or fitted into the lower end of a pinion shaft 154. A pinion or spiral bevel gear 134 on the upper end of the pinion shaft 154 meshes with a spiral sprocket gear 136.

In use, as the rider moves the pedals, the front sprocket 46 rotates and drives the rear sprocket 48 via the belt 70. The rear sprocket 48 drives the sprocket gear 136 which in turn drives the pinion gear 134. The pinion gear 134 drives the pinion shaft 154, the gear collar 128, the propeller cable 130, and the propeller 112. The gear box 106 may be sealed from the outside environment and lubricated for life. In the example shown, the front/rear sprocket ratio is 1:2.5, and the sprocket gear/pinion gear ratio is 1:3, so that one revolution of the front sprocket 46 turns the propeller through 7.5 revolutions.

Figure 19:
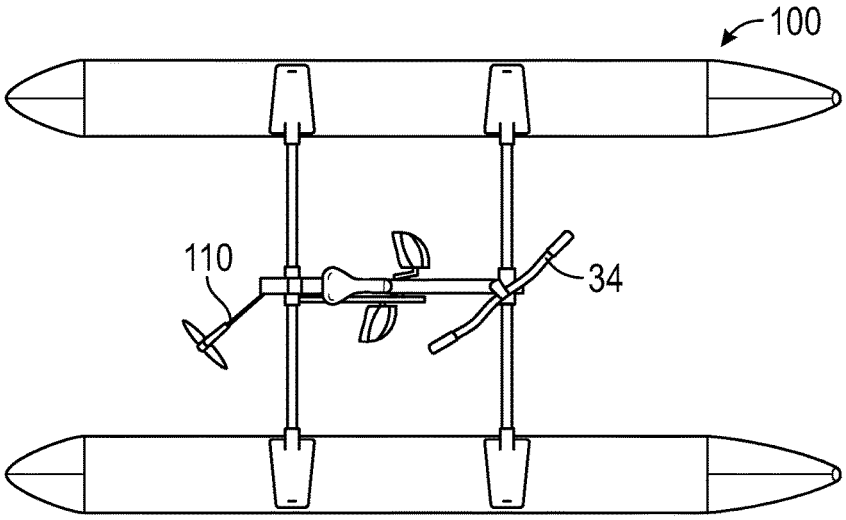
FIG. 19 is a top view showing the steering system of the water bike of FIG. 12 is a right turn position.

The rider steers the water bike 20 or 100 by rotating the handle bar 34, similar to a conventional land bicycle. Unlike the embodiment of FIGS. 1-11, in the embodiment of FIGS. 12-24, the axis PP of the propeller 112 (shown in FIGS. 8 and 17) is fixed relative to the outdrive 110, and the entire outdrive 110 pivots to effect steering, as shown in FIG. 19. Hence, the outdrive acts as a rudder to assist in steering, in addition to providing the vectored thrust of the propeller 112.

Unlike rudder-based designs, the outdrive 110 allows for steering even if the water bike is not moving. It also allows the water bike 100 to turn in a circle within the length of the water bike 100. The outdrive 110 also allows the rider to hold the water bike 100 up against a dock or boat, by steering to a 90 degree position while continuing to pedal. The outdrive 110 may optionally also be steerable +/−180 degrees to allow the water bike 100 to move in a reverse direction. Generally, if the rider pedals in reverse with moderate effort and the clutch plate 158 is properly adjusted, the outdrive 110 and gear box 106 will pivot up, allowing the water bike to move onto a beach with little or no contact between the skeg and the bottom. Correspondingly, even with the propeller partially submerged, pedaling forward will cause the outdrive and gearbox to pivot into the full down position shown in FIG. 12. The clutch plate 158 may be adjusted to a higher holding force to allow forceful reverse movement of the water bike, if desired.

The outdrive 110 may optionally be used in the embodiment shown in FIGS. 1-11. The sprockets and chain described may be replaced with pulleys or cogs and belts or cables, and vice versa.

The water bike 100 may be assembled and dis-assembled without using tools via push buttons on the cross beams 24 and a quick release pin on the outdrive 110. The outdrive 110 may optionally stay attached to the water bike 100 for transport. The gearbox 106 and outdrive 110 may also be used in other types of water craft, such as single hull water craft, as the pontoons are described only as an example.

Figure 24:
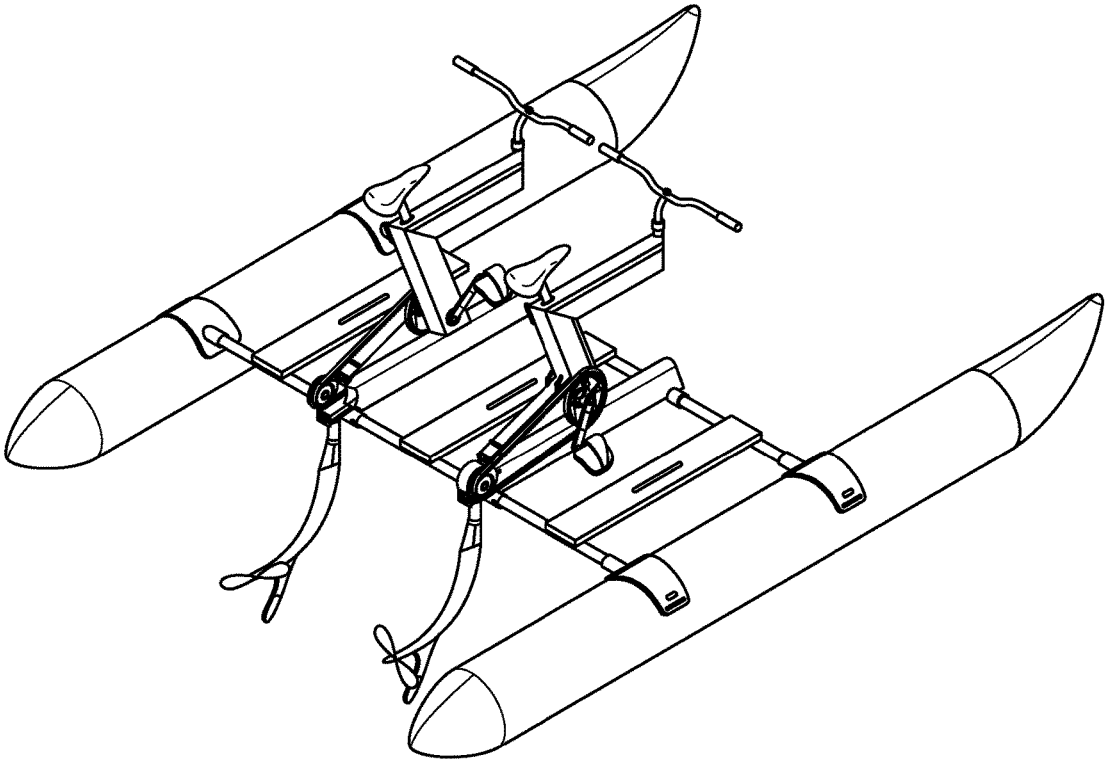
FIG. 24 is a perspective view of a modification of the water bike of FIG. 12 for use by two riders.

As shown in FIG. 24, the water bike 20 or 100 may be modular and allow for quick assembly and dis-assembly, as well as for providing two frames 26 and outdrives 110 on a single water bike. As shown in FIG. 21, the frames 26 may be provided with front and rear frame tubes 162. The cross beams 24 may be provided as tube sections extending through or locked into the frame tubes 162, optionally via quick release spring biased pin locks 164. The single frame design shown in FIG. 12 can then be quickly changed over to the two frame design shown in FIG. 24. A center pontoon or other floatation element may be attached to the cross beams 24 between the two frames. As described here, supported on or attached to means supported or attached directly or indirectly via one or more intermediate elements), and attached directly or indirectly.

Thus, novel inventions have been shown and described. Various changes and substitutions may of course be made without departing from the spirit and scope of the inventions. The inventions, therefore, should not be limited, except by the following claims, and their equivalents.

The invention claimed is:

1. A water bike comprising:

at least one floatation element;

a frame supported on the at least one floatation element;

a steering bar pivotally attached to the frame;

pedals attached to a front sprocket rotatably supported on the frame;

a chain or belt extending around the front sprocket and around a rear sprocket;

a propeller on an outdrive mechanically linked to a gearbox by a flexible propeller cable extending through the outdrive, with the outdrive pivotal relative to the gearbox; and a steering linkage connecting the steering bar to the outdrive, for pivoting the outdrive to steer the water bike.

2. The water bike of claim 1 with the gearbox pivotable about a horizontal axis to allow the outdrive to move from a first position below the gearbox to a second position above the gearbox.

3. The water bike of claim 1 wherein the steering linkage comprises at least one cable attached to a steering pulley rotatably attached to the gear box.

4. The water bike of claim 1 with the outdrive comprising a fin-shaped outdrive housing.

5. The water bike of claim 4 further comprising a fin on the fin-shaped outdrive housing projecting down below a rotation axis of the propeller.

6. The water bike of claim 4 with the propeller cable having a first end connecting with the gear box and a second end connecting with the propeller, and with the first end perpendicular to the second end.

7. The water bike of claim 4 with the fin-shaped outdrive housing acting as a rudder to assist steering of the water bike.

8. The water bike of claim 1 with the outdrive rotatable by at least +/−180 degrees relative to the gearbox.

9. A water bike comprising:

first and second spaced apart floatation elements;

front and rear cross members attached to the first and second flotation elements;

a frame supported on the front and rear cross bars, with the frame having a horizontal drive section supported on the front and rear cross members, a riser joined to the drive section and a horizontal top section joined to the riser;

a steering bar pivotally attached to a front end of the horizontal top section of the frame;

pedals attached to a pedal shaft extending through the riser;

a first sprocket attached to the pedal shaft;

a gearbox at a back end of the horizontal drive section of the frame, with the gearbox including a sprocket gear, a cable gear engaged with the sprocket gear, and a second sprocket attached to the sprocket gear;

a chain or belt extending around the first sprocket and the second sprocket;

a steering pulley pivotally attached to the gearbox;

an outdrive engaged with the steering pulley, with the outdrive including a fin-shaped outdrive housing, a tubular cable housing within the outdrive housing, a flexible propeller cable within the tubular cable housing, a propeller attached to a lower end of the propeller cable and the cable gear attached to an upper end of the propeller cable; and a steering linkage connecting the steering bar to the steering pulley, for pivoting the outdrive to steer the water bike, with the fin-shaped outdrive housing acting as a rudder to assist steering of the water bike.

10. The water bike of claim 9 with the gearbox pivotable about a horizontal axis to allow the outdrive to move from a first position below the gearbox to a second position above the gearbox.

11. The water bike of claim 9 with the outdrive housing having a maximum width of 50 mm.

12. The water bike of claim 9 with the fin-shaped outdrive housing comprising a composite structure molded around the tubular cable housing.

13. The water bike of claim 9 with the tubular cable housing curving through ¼ turn.

14. The water bike of claim 9 with the fin-shaped outdrive housing having a width and a front-to-back dimension greater than the width.

15. The water bike of claim 9 with the second sprocket outside of the gearbox, and with the second sprocket and the sprocket gear attached to an axle.

16. The water bike of claim 10 with the gearbox including a bearing plate and a pinion plate attached to a main housing, and with the axle extending through the bearing plate and through a clutch plate positioned between the bearing plate and a mounting plate rigidly attached to the frame.

17. The water bike of claim 9 with the outdrive attached to the gearbox via a quick release pin to allow the outdrive to be removed from the water bike by removing the quick release pin.

18. The water bike of claim 9 further comprising a fin on the fin-shaped outdrive housing projecting down below a rotation axis of the propeller.

19. The water bike of claim 13 further including a centering tube holding the cable housing in place within the outdrive housing.

20. A water bike comprising:

at least one floatation element;

a frame supported on the at least one floatation element;

a steering bar pivotally attached to the frame;

pedals attached to a front sprocket rotatably supported on the frame;

a chain or belt extending around the front sprocket and around a rear sprocket;

a propeller on an outdrive mechanically linked to a gearbox by a flexible propeller cable extending through the outdrive, with the outdrive pivotal relative to the gearbox, the outdrive comprising a fin-shaped outdrive housing;

a tubular cable housing within the fin-shaped outdrive housing, and the flexible propeller cable within the tubular cable housing; and a steering linkage connecting the steering bar to the outdrive, for pivoting the outdrive to steer the water bike.

* * * * *